United States Patent [19]

Bates

[11] 4,432,100

[45] Feb. 21, 1984

[54] PROTECTIVE HELMET VISOR

[76] Inventor: Ronald E. Bates, Rte. 1, Box 23, Midland, Va. 22728

[21] Appl. No.: 369,010

[22] Filed: Apr. 16, 1982

[51] Int. Cl.[3] ..... A42B 3/00; A61F 9/04

[52] U.S. Cl. ..... 2/424

[58] Field of Search ..... 2/10, 424, 425, 6, 8, 2/9

[56] References Cited

U.S. PATENT DOCUMENTS

| | | | |
|---|---|---|---|
| 2,204,688 | 6/1940 | McClung et al. | 2/10 |
| 3,336,598 | 8/1967 | Aebersold et al. | 2/10 |
| 4,287,615 | 9/1981 | Morin | 2/424 |

FOREIGN PATENT DOCUMENTS

| | | | |
|---|---|---|---|
| 57205 | 1/1940 | Denmark | 2/10 |
| 2921353 | 12/1980 | Fed. Rep. of Germany | 2/424 |
| 2068212 | 8/1981 | United Kingdom | 2/424 |

*Primary Examiner*—Peter P. Nerbun

[57] ABSTRACT

Herein is a disclosed a transparent safety visor which may be retrofitted to protective hardhat helmets. Such helmets typically consist of an inverted bowl defining a number of key receptor sites at intervals around its interior circumference, and a liner cap including a central crown and a number of struts radiating therefrom and terminating in keys adapted to be releasably locked to the receptor sites to maintain the liner cap and bowl in a fixed relationship. The visor is made of a flexible, transparent, generally rectangular plastic sheet, with at least a pair of slots in the sheet through which are inserted a corresponding number of liner cap keys prior to placement thereof in the receptor sites. The lower edge of the visor extends below the edge of the helmet to provide a gripping surface for user adjustment of the position of the visor, and the upper edge of the visor slides between the liner cap and the bowl when adjusted. The upper edge is pressed against the interior of the bowl by the liner cap and by the visor's resistance to curvature, thus establishing friction which maintains the visor in a stationary position until adjusted.

6 Claims, 4 Drawing Figures

Fig. 2
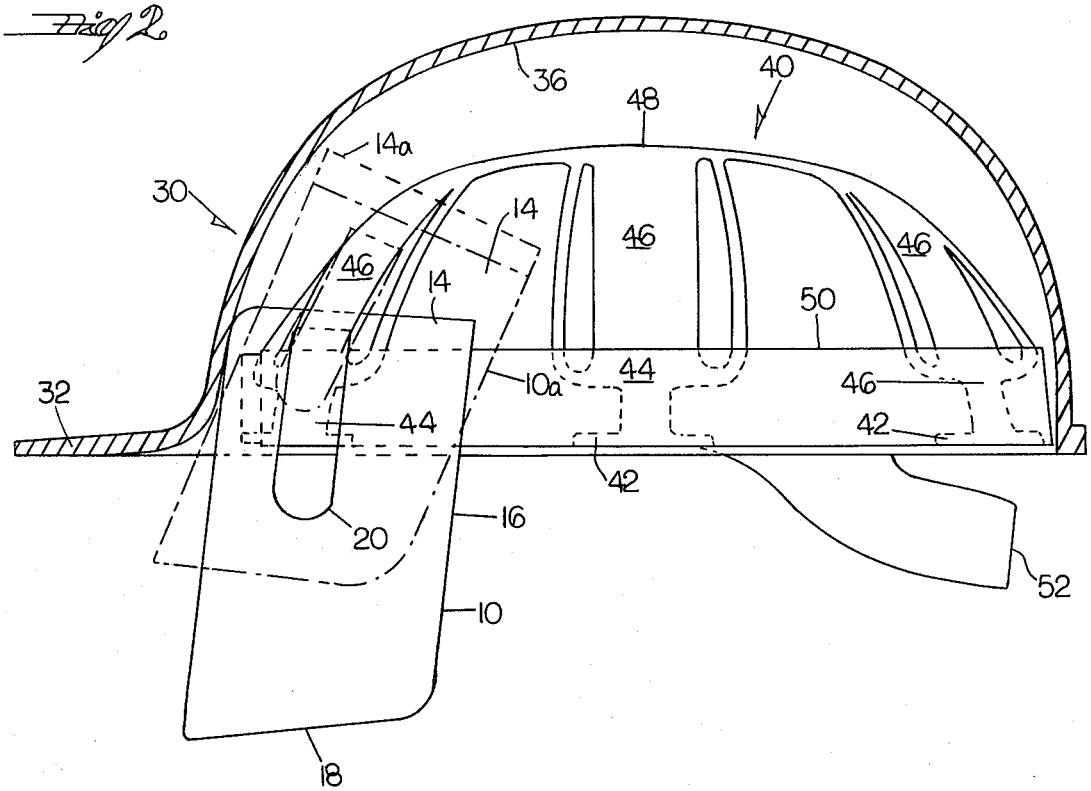
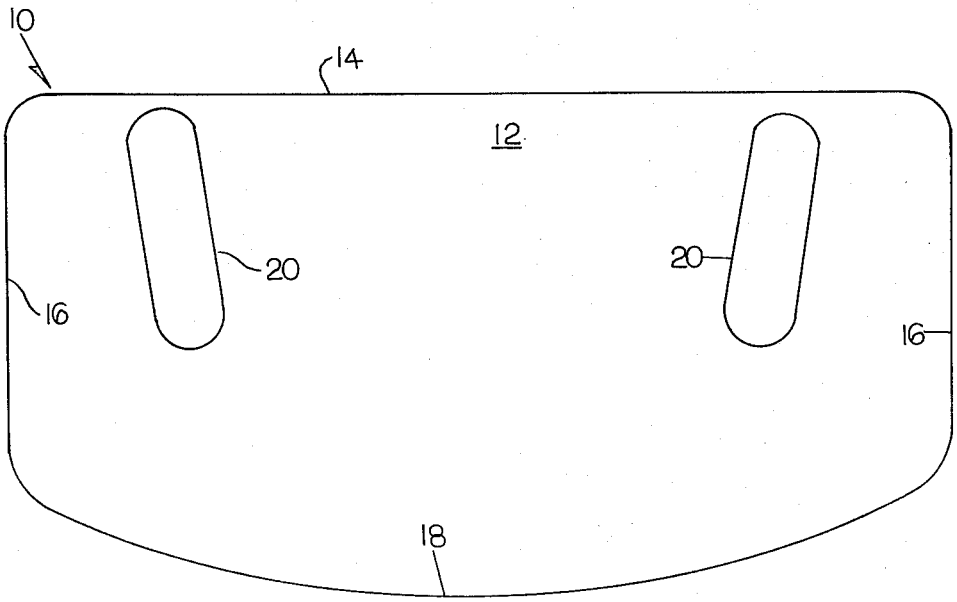
Fig. 1

PROTECTIVE HELMET VISOR

BACKGROUND OF THE INVENTION

This invention relates to eye protection and, more specifically, to a slidable visor which may be retrofitted to a standard hardhat construction helmet.

Modern construction techniques involve a variety of procedures which result in hazards to the eyes of construction workers. Such hazards may include solid particulate matter or liquids which are sprayed, dropped, or otherwise propelled by acts such as spray painting, sawing, grinding, or hammering into a brittle surface. Additionally, heavy or sharp tools are often exposed at eye level and may be carelessly operated or directed by workers. The hazards of the work place are well-known and have been described voluminously and with occasional eloquence in many publications.

At the present time, the primary means of eye protection in the work place are goggles. These are typically restrained against the face of the wearer by an elastic strap which reaches around the head, and the goggles are shaped so as to maintain a seal around the eyes to prevent the instrusion of dust, mist, and other airborne hazards. Goggles offer reliable protection in moderately severe conditions, but have drawbacks if the hazards faced are less severe. As one example, the installation of small spikes in masonry produces occasional dust and flying chips. A tight seal surrounding the eyes in such a situation is unnecessary, and goggles restrict peripheral vision and may irritate facial skin and scalp around the headband. Moreover, goggles require preplanning or cessation of work in order to place or remove them around the eyes, and this has led many workers in situations where goggles are the only form of eye protection available to forego eye protection altogether. Thus, for less hazardous work place conditions, a less inconvenient form of eye protection would be very useful to construction workers.

U.S. Pat. No. 2,815,508 discloses a safety helmet bearing an integral retractable eye shield. The helmet is a rigid shell having a generally hemispherical contour with a pair of indentations formed in the outer surface of the shell above either side of the face of the helmet wearer. The indentations extend upwardly from the lower rim of the shell, and each indentation contains an elongated track for retaining the eye shield. The shape and dimension of the eye shield conforms to the surface of the helmet between the indentations, and the edges of the shield corresponding to the indentations bear sliders which are adapted to be slidably received on the tracks. This design presents a marked degree of friction between the slider's track, which prevents the shield from being moved with one hand either downward to a shield or upward to a non-shield position. Moreover, the external nature of the shield prevents use with a helmet featuring a forward brim.

U.S. Pat. No. 3,315,272 discloses a helmet bearing dual external visors. One such visor is designed with maximal structural strength for wind resistance in situations such as motorcyclist usage. A second visor is provided with tinting for ambient light reduction. Either or both visors may be placed in front of the face of the user. Both visors ride on external tracks atop the helmet and may be locked into place utilizing threaded knobs which pass through a central slot in each visor into the helmet tracks. Movement of these visors requires a great deal of hand manipulation and attention to the task, while taking attention away from other activities such as driving a motorcycle. Additionally, the central slot in each visor impedes binocular vision straight ahead of the wearer.

U.S. Pat. No. 4,287,615 discloses a pivoted visor shield which may be withdrawn up into the outer shell of a helmet. The visor is supported on a bow member which is rotatably held at two opposite points on either side of the face of the wearer to the helmet. When withdrawn within the helmet, the visor rests between an inner cap of the outer helmet. The patent states that, in order to move the visor from a withdrawn position to an exposed position, both ends of the bow must be moved to the rear simultaneously in order to pivot the bow and bring the visor forward and down. This clearly requires the wearer to commit more than one hand to the action, thereby taking control and attention away from any other activity.

Thus it can be seen that the prior art has failed in many crucial respects to provide a visor in combination with a helmet permitting easy adjustment of a visor between a withdrawn position and an exposed position. Also, the prior art requires that the helmet be manufactured in a specific or customized fashion in order to accommodate the visor structure. It would clearly be much more economical to provide a visor which may be retrofitted as to the hardhat design already possessed by and familiar to those whose work involves occasional hazard to the eyes and head.

SUMMARY OF THE INVENTION

According to the invention, there is provided a visor which may be conveniently retrofitted to the typical hardhat design now in use throughout the construction industry. The helmet typically includes an outer shell of standard size, a front brim extending approximately two inches beyond the shell, and a plurality of keyed slots surrounding the interior design edge of the shell. These slots include two which are placed at opposite sides of the brim, beyond the normal width of the wearer's eyes. An adjustable interior plastic cap and headband of well-known conventional design are also provided which allows the wearer to adjust the fit to match the size of the wearer's head. The cap includes extensions which releasably lock into the keyed slots of the shell, thereby securing the cap to the shell and maintaining a space there between. The visor of the present invention may be of any approved transparent safety plastic, typically 0.040 inch thick. The visor includes two slots on the upper portion thereof which are spaced apart a distance equal to that between the two keyed slots aside the brim of the helmet shell. The width of the visor slots is chosen so that the cap extension may extend therethrough to lock into the keyed slots, while being of a width sufficient to allow easy movement of the visor in the space between the cap and the outer shell. This permits the visor to be exposed and withdrawn with one hand by the wearer while a remaining hand controls, for instance, a power tool. Since the inner cap is easily removed and replaced, the visor may be retrofitted to the helmet without undue cost or difficulty. As the visor is withdrawn into the helmet, the decreasing radius of the helmet curves the flexible visor plastic which develops a compressive resistance in the visor. Thus the visor presses back against the helmet shell and develops friction which maintains the visor in place until the wearer pulls it down into the exposed position once again. These and other objects and advantages of the invention will be apparent from the following description which is given by way of example with reference to the accompanying drawings.

BRIEF DESCRIPTION OF THE DRAWINGS

FIG. 1 is a front view of a protective visor provided according to the present invention;

FIG. 2 is a cut-away side view of a hard hat helmet showing the installation of the visor of FIG. 1 therein;

DETAILED DESCRIPTION OF THE DRAWINGS

Figure 3:
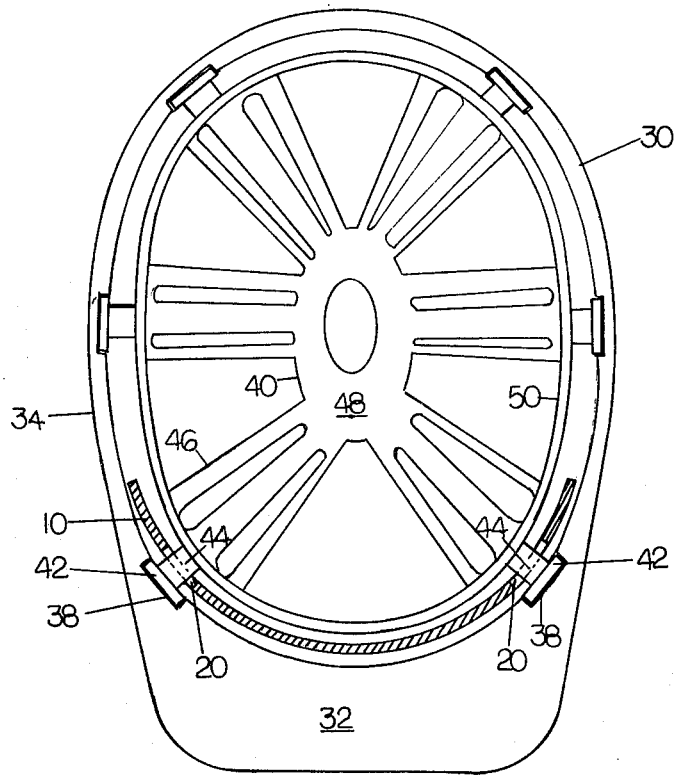
FIG. 3 is a bottom view of the helmet and the visor of FIG. 2.

The best mode and preferred embodiment of the present invention is illustrated in FIGS. 1 through 4. Turning to FIG. 1, according to the present invention there is provided a protective visor generally indicated at 10, comprising a planar transparent sheet plastic item 12 defining a top edge 14, sides 16, and lower edge 18. Also defined within plastic item 12 are a pair of key slots 20, each of an elongated form on axes oriented as will be more fully described herein below. The sheet plastic item 12 is preferably any transparent plastic exhibiting the flexibility and hazard resistance required by the use thereof as described herein. One such plastic which is available off the shelf for this purpose is a 0.040 inch thick sheet product of the American Optical Company. The visor 10 may be advantageously formed by cutting, stamping, pressing, or any other conventional method.

Turning to FIGS. 2 and 3, a well-known conventional hard hat helmet is illustrated. The helmet includes an inverted bowl 36 having one portion of its edge flattened and extended to define a forward brim 32. Extending from opposite sides of the forward brim 32 around the remainder of the edge of bowl 36 is upturned brim 34. The helmet is typically worn with the forward brim above the eyes to protect the eyes and face of the wearer, while the upturned brim will catch and retain small amounts of liquid which may strike the helmet. The upturned brim also prevents potentially sharp edges of the bowl 36 from chafing against the skin or scalp of the wearer.

A liner cap 40 is mounted within the interior of helmet 30. The liner cap 40 is also of well-known conventional design, and permits adjustment to fit the head of the wearer as well as shock-absorbing suspension of the helmet. Thus, materials striking the helmet at high momentum will not transmit disruptive or injurious shock through the skull of the wearer. The liner cap 40 comprises a central crown 48 from which radiates a plurality of struts 46 which detachably join a generally circular headband 50 in a conventional manner. Additionally, outside the periphery of the headband 50, each strut 46 joins a narrower extension 44 which terminates in a widened suspension key 42. A plurality of key receptors 38 are defined within helmet 30 adjacent keys 42 surrounding the periphery of headband 50. The keys 42 and key receptors 38 are designed to provide releasable locking of the liner cap 40 into the helmet 30 by mating with one another in any well-known conventional manner. Two such keys and receptors are located on opposite sides of the forward brim 32.

A lower extended back band portion 52 of the headband 50 provides a well-known conventional means of size adjustment for the liner cap 40 to accommodate the head of the wearer. Alternatively, the wearer may disengage the liner cap 40 from the helmet 30 by releasing the keys 42 from the receptors 38, and exchange the liner cap for another of an appropriately larger or smaller size.

Figure 4:
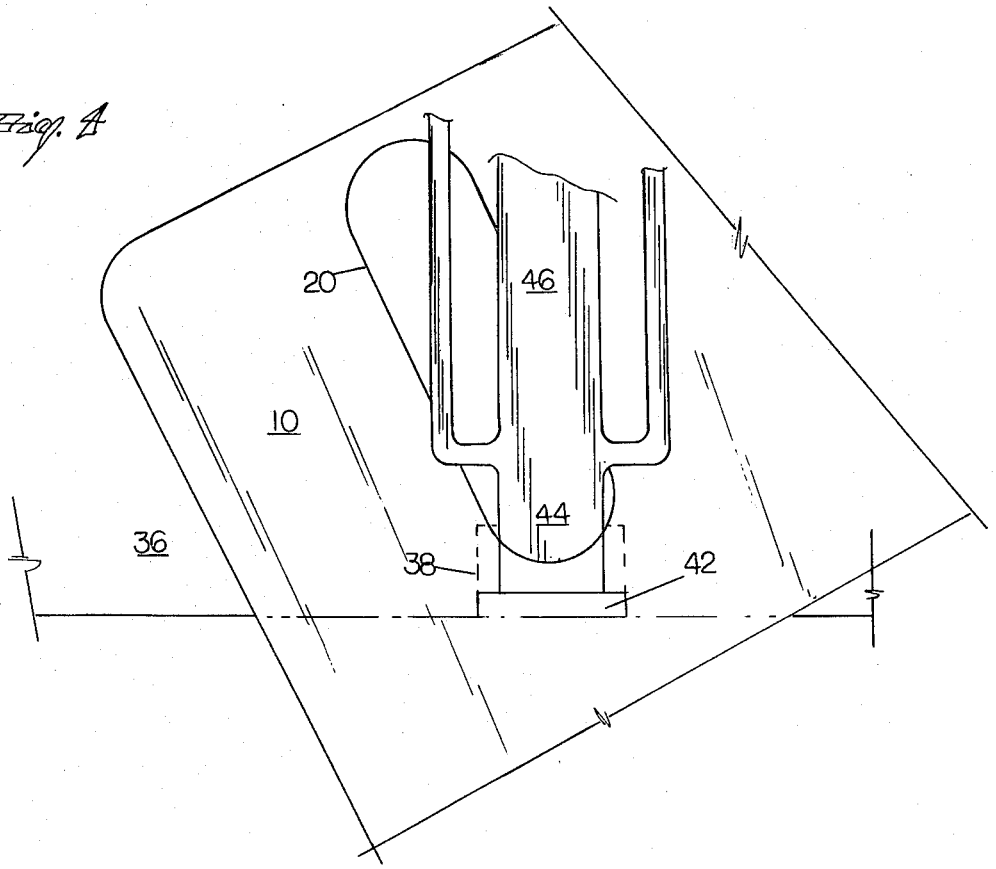
FIG. 4 is an isolated perspective view of a portion of the visor and helmet of FIG. 2.

FIG. 4 illustrates the manner in which the visor 10 is secured to the helmet 30. The two suspended keys 42 on either side of the brim 32 are disengaged from their respective receptors 38, and are passed through slots 20 in visor 10 so that upper edge 14 of visor 10 extends between the bowl 36 and cap 40. The portion of visor 10 adjacent slots 20 extends between extensions 44 attached to keys 42 and head band 50. The width of each slot 20 is greater than that of extension 44 but less than that of key 42 or upper strut 46. The upper edge of the slot 20 is prevented from descending any farther than the point at which each key 42 joins receptor 38. The bottom edge of each slot 20 is prevented from ascending any farther than the point at which extension 44 joins upper strut 46. Thus, the length of each slot 20 and its position within the visor 10 determine the highest and lowest position of lower edge 18 with regard to the face of the helmet user.

The axes of the two slots 20 are oriented so as to intersect substantially below the center of the visor 10. Thus, when the visor is pushed by the wearer upward into the helmet, the upper edge 14 of the visor 10 is increasingly flattened by interaction of the slots and keys as the visor ascends, while being forced into increasing curvature due to contact with the bowl 36 as the upper edge of 14 approaches the apex of the bowl 36. The curved visor 10 presses outward towards its original flat configuration against the bowl 36, and the friction of visor 10 and bowl 36 maintain the visor in its position when the wearer completes upward or downward adjustment thereof.

In a typical working embodiment of the invention, the visor extends 1.75 inches below the brim 32 when fully retracted into helmet 30, and 4.25 inches below the brim when fully extended from helmet 30. The width of visor 10 is such that the edges 16 reach approximately to the keys 42 adjacent those keys inserted through slots 20. It would be an obvious modification of the invention to extend the width of the visor 10 and provide additional pairs of slots 20 to engage additional keys 42.

In the foregoing description, the invention has been described with reference to a particular preferred embodiment, although it is to be understood that the specific details shown are merely illustrative and the invention may be carried out in other ways without departing from the true spirit and scope of the following claims.

What is claimed is:

1. A retractable protective visor for a hard hat helmet of the type having an inverted bowl, a forward brim extending from one edge of said inverted bowl, a plurality of receptors adapted to receive releasable locking keys and spaced about the interior edge of said bowl, two said receptors being positioned on opposite sides of said forward brim, and a liner cap comprising a crown and a plurality of struts radiating therefrom and terminating in releasable keys adapted to be releasably held in said receptors, said visor comprising a flexible transparent sheet of protective material defining first and second linear key slots, each said slot being of sufficient width to admit one said strut when said liner cap is removed from said helmet, said slots being spaced apart from one another a distance equal to the distance between said two receptors on opposite sides of said forward brim, so that said struts corresponding to said two receptors pass through said slots and said visor is retained thereby in said helmet when said liner cap is installed in said helmet, and an upper edge of said visor rests between said liner cap and said bowl and is compressed against said bowl to retain said visor in an upward unexposed position by friction while permitting downward movement of said visor limited by the length of said slots in response to single-hand manipulation by the wearer.

2. The apparatus of claim 1 wherein said visor is made of a transparent plastic material.

3. The apparatus of claim 2 wherein said transparent plastic material is 0.040 inches thick.

4. A transparent protective visor adapted to be retrofitted to a hard hat protective helmet of the type having an inverted bowl surrounding a liner cap, the interior periphery of said bowl defining a plurality of key receptors, said liner cap defining a plurality of keys adapted to be releasably interlocked with said key receptors in order to maintain said liner cap positioned within said bowl, said visor comprising a flexible transparent plastic sheet defining a plurality of linear key slots, each said slot being positioned and adapted to receive a corresponding one of said keys which is thereafter installed in a corresponding one of said receptors, so that said visor is held between said bowl and said liner cap, each said slot being oriented and adapted to permit manual movement of said visor into and out of said bowl.

5. Apparatus as claimed in claim 4, wherein said visor presses outward against the curvature imposed thereon by said bowl, thereby creating friction between said visor and said bowl so that said visor remains stationary with respect to said bowl until moved upward or downward by the wearer.

6. A protective transparent visor for a hard hat helmet including an inverted bowl and a liner cap releasably joined at a plurality of points spaced apart along the interior circumference of said inverted bowl, said visor comprising a transparent plastic sheet defining at least a pair of elongated linear slots having a substantially vertical orientation, said slots being spaced apart and each said slot being adapted to surround one said point at which said liner cap joins said bowl, so that the upper edge of said visor rests against said bowl between said liner cap and said bowl, and a lower edge of said visor extends beneath said bowl to provide a gripping surface for single-handed movement of said visor into and out of said bowl, and wherein said visor is pressed against the interior of said bowl by said liner cap so that friction between said bowl and said visor maintains said visor in a stationary position until adjusted by a wearer.

* * * * *